US008715464B2

(12) United States Patent
Young et al.

(10) Patent No.: US 8,715,464 B2
(45) Date of Patent: May 6, 2014

(54) SOY STALK AND WHEAT STRAW PULP FIBER MIXTURES

(75) Inventors: Richard Henry Young, Eagle River, AK (US); Jason Heezen, Plankinton, SD (US)

(73) Assignee: Pure Pulp Products, Inc., Plankinton, SD (US)

( * ) Notice: Subject to any disclaimer, the term of this patent is extended or adjusted under 35 U.S.C. 154(b) by 12 days.

(21) Appl. No.: 13/506,851

(22) Filed: May 21, 2012

(65) Prior Publication Data

US 2013/0306260 A1 Nov. 21, 2013

(51) Int. Cl.
*D21H 11/12* (2006.01)

(52) U.S. Cl.
USPC ..... 162/148; 162/97; 162/99; 162/146; 162/149

(58) Field of Classification Search
CPC ..... D21H 5/008; D21H 5/14; D21H 5/26; D21H 11/12; D21J 1/00; D21J 1/16
USPC ..... 162/90–99, 147, 148, 231, 146, 149; 264/640, 641, DIG. 75
See application file for complete search history.

(56) References Cited

U.S. PATENT DOCUMENTS

| | | | | |
|---|---|---|---|---|
| 4,468,428 | A | 8/1984 | Early et al. | |
| 5,705,216 | A | 1/1998 | Tyson | |
| 6,492,574 | B1 | 12/2002 | Chen et al. | |
| 7,910,338 | B2 * | 3/2011 | Hennessey et al. | 435/99 |
| 2003/0176669 | A1 * | 9/2003 | Thorre | 536/1.11 |
| 2007/0049661 | A1 | 3/2007 | Neel et al. | |
| 2007/0199669 | A1 | 8/2007 | Yang et al. | |
| 2010/0285534 | A1 * | 11/2010 | South et al. | 435/72 |
| 2011/0094678 | A1 * | 4/2011 | Blount | 156/336 |
| 2011/0146928 | A1 * | 6/2011 | Huang et al. | 162/168.1 |
| 2012/0125548 | A1 * | 5/2012 | Cohen | 162/17 |

FOREIGN PATENT DOCUMENTS

CN 101703314 * 5/2010

OTHER PUBLICATIONS

CN 101703314, May 2010, English language translation.*

* cited by examiner

*Primary Examiner* — Eric Hug
(74) *Attorney, Agent, or Firm* — Clark Hill PLC

(57) ABSTRACT

This invention relates to annual crop straw and stalk fibers having properties suitable for use in paper, paperboard, and related products disposable paper plates, cups, and bowls, molded and thermoformed pulp products, disposable food handling containers, tissue and toweling, and absorbent products such as airlaid roll goods, wipes, diapers and feminine hygiene articles. Annual crop straw or stalk is the waste product from the harvesting of the food including soy, wheat, corn, rice, and oats. The food chain is not impacted by use of these stalks and straw. Currently, most of the straw or stalk is burned, tilled under for soil amendment, or otherwise disposed of. Use of this stalk or straw for paper, paperboard and related products, and absorbent products manufacture including any product made from cellulose fibers represents an opportunity to provide additional income to farmers and a green alternative to wood pulp and therefore conserve trees.

28 Claims, 4 Drawing Sheets

SOY STALK AND WHEAT STRAW PULP FIBER MIXTURES

TABLE OF CONTENTS

Background of the invention:
Reference application U.S. #20070199669 Yang:
Reference Application, U.S. #20070049661:
Reference Application, U.S. #20080032147A1:
Reference Patent U.S. Pat. No. 6,492,574:
Reference Patent U.S. Pat. No. 5,705,216:
Reference Patent U.S. Pat. No. 4,468,428, P&G:
Summary of the Invention:
Description of the views of the Drawings
Detailed Description of the Preferred Embodiments:
Example #1:
Example #2:
Example #3:
Table 1
FIG. 1
FIG. 2
FIG. 3
FIG. 4
Claims:
Abstract:

BACKGROUND OF THE INVENTION

The present invention relates to annual crop straw and stalk fibers which have suitable properties for use in paper, paperboard and related products made therefrom, disposable dinner plates, cups, and bowls, molded pulp containers, and food trays and food handling containers, clamshell containers, tissue and toweling, and absorbent products such as diapers, roligoods, and feminine hygiene articles. Other uses include reconstituted cellulose such as rayon and electronic article packaging. Up to this time, farmers have the alternatives of tilling part of the stalk and straw back into the soil and disposal of the excess. Only a portion of the stalks can be reasonably tilled back into the soil each year. Therefore, the farmer is faced with disposal of large quantities of the waste stalk and straw after harvesting the food crop. Straw and stalk have been burned in the past, but this is obviously not an environmentally friendly process due to the air pollution created. The use of straw and stalk fibers in high value products also represents an opportunity to the farmer to recover additional income per acre of crop land without impacting the food crop supply.

A significant amount of effort has been undertaken to use annual crop waste straw such as wheat, oats, soy, corn, sugar cane, and rice in paper and paperboard products. The opportunity in this area is to use waste materials from agricultural products which decreases need and cost of waste disposal, increases value to the fanner, and provides a viable replacement for wood pulp, thereby saving trees. Also, the use of the waste straw and stalks does not impact the food supply. This approach represents the next level of "Green" or environmentally responsible manufacturing. Also, the annual crop fibers have the potential of providing enhanced properties compared to wood pulp. Wheat straw has been made into pulp fibers, and wet laid into paper products. Much work has been done in Canada and United States as well as China to process Wheat into paper for printing. In Canada, the Alberta Research Center has taken Wheat straw from China and processed it into printable paper called Wheat Sheet and it was used to print a publication of National Geographic in 2008. The Wheat Sheet had 20% wheat fiber and 80% wood pulp fiber. The pulping and recovery systems proved to lack commercial economic viability. Also, chlorine bleaching is an environmentally undesirable process. The present invention relates to processes and applications that do not require chlorine bleaching to be suitable for paper, paperboard, and related products, and absorbent product end uses.

Reference Application U.S. #20070199669 Yang:

The reference patent application relates to processing of annual crops for the formation of long, coarse fiber bundles for use in textiles and composites. This reference teaches towards maintenance of high coarseness, long fiber bundles from annual crop straw and teaches away from formation of individual fiber cells, low coarseness and shorter fibers consisting of small multiple cells bonded in the manner of the original straw which are unsuitable for textile use. The fibers and the process of the reference application are intended to be a coarseness of at least one denier and preferably 30 denier and larger. The process creates fibers having a variety of coarseness levels and that have approximately 10-30% of the fibers that are suitable for textiles. The desirable high coarseness fibers must then be extracted from the digested fiber mass for use in textiles.

Reference Application, U.S. #20070049661:

The reference relates to the use of soy and other annual crop straw and stalks for use in strandboard. The technology includes the step of de-pithing, cutting to length, drying and applying resin and wax to bind the fibers into the final strandboard product. No digesting or cooking of the fibers is involved. The straw and stalks are simply mechanically processed or steam treated into long bundles of fibers with little or no separation into smaller fiber cells.

Reference Application, U.S. #20080032147A1:

This reference relates to the use of annual crop fibers for Medium Density Fiberboard (MDF). The straw and stalks are steam treated to open the fibers enough to create fibers suitable for MDF manufacture. No digestion or bleaching or lignin removal is indicated.

Reference U.S. Pat. No. 6,492,574:

General reference to use of wheat straw as a source of cellulose for absorbent articles, but no mention of soy stalk fiber or any specific enabling technology for processing the wheat or fiber specific properties or dimensions.

Reference U.S. Pat. No. 5,705,216:

Describes process for steam treatment and extrusion of straw to make hydrophobic fibers suitable for injection molded plastics. The reference patent does not mention use of soy stalk fibers.

Reference U.S. Pat. No. 4,468,428, P&G:

This patent discloses use of wheat straw fibers and other micro-fibers having diameter of 0.5 to 10 microns and an absorbent pad density of 0.04 to 0.15 g/cc. for use in absorbent articles such as diapers.

Although the above indicated technologies have been used to produce fibers from annual crops, to date there have been none that are technologically, commercially and economically viable for use in paper and related products and none that have been suitable for use in absorbent products. Also, none have shown the appearance and color needed for certain paper, tissue and toweling, molded pulp products, paperboard, and absorbent products without chlorine bleaching which is environmentally undesirable and economically unfeasible.

Furthermore, these references do not disclose mixtures of soy and wheat fibers, which mixtures have surprisingly improved properties and value including but not limited to twice the available fiber (acres of crop) due to required crop rotation and more flexibility in fiber furnish that can be processed at the same operating conditions, requiring little or no process changes or adjustments. In order to maintain soil quality, soy is typically rotated with wheat every year, resulting in a field providing wheat or soy every other year. The mixtures also provide more pleasing color than each fiber alone and the mixtures provide improved processing for the Thermoformed Pulp process including more effective of water spray trimming and elimination of steam bubbles during the drying and molding step of the process associated with the use of 100% wheat straw fiber.

SUMMARY OF THE INVENTION

The aforementioned opportunities for use of all species of annual crops are realized by the use the fibers of the present invention containing soy stalk fibers, and straw from wheat and other annual crops in paper, paperboard, linerboard, related wet laid paperboard and products made therefrom, tissue and toweling, napkins, Molded Pulp, Transfer Molded Pulp, Slush Molded Pulp, and Thermoformed Pulp applications, reconstituted cellulose such as rayon, food handling service and packaging products such as trays, clamshell boxes, meat trays, serving trays, plates, cups and bowls, packaging for electronics and other items, and in absorbent products including diapers, feminine hygiene products, airlaid rollgoods, and wipes. Fibers of the present invention are produced from soy stalks and wheat straw, and other annual crops which are chopped and digested with caustic or other suitable cooking liquors and various cooking sequences of time, temperature and agitation. The digested fibers are then refined to various degrees of coarseness appropriate to the end use application. A higher level of cooking and higher level of refining creates fibers with lower coarseness and shorter length. Conversely, a lower level of cooking and refining results in a longer apparent fiber length and higher coarseness indicated by larger apparent fiber diameter consisting of multiple fiber cells that remain bonded in the manner of the original straw or stalk. For example, the lower coarseness fibers are suitable for smooth, strong paper and paper board. Higher coarseness fibers are suitable for better wet laid drainage and possible use in wet laid tissue and toweling and in some forms of paperboard or other wet laid products that require good drainage properties. The digesting and refining conditions may be optimized for a suitable balance of paper strength and smoothness and drainage rate. The improved color of the soy and wheat mixtures is attained at all levels of digestion and refining. It has been discovered that the same digesting and refining conditions that are used for wheat straw can be used for soy stalk to provide appropriate fiber for the specific application. Since the soy stalk and wheat fiber can be digested and refined at the same conditions and the mixtures converted to end products at same conditions, there is little to no need to change operating conditions over a broad range of mixtures such as 5% soy/95% wheat to 95% soy/5% wheat by weight. These aforementioned characteristics of the soy and wheat mixtures provide unique benefits and value to the fiber manufacturer and the end product manufacturer.

Also, a suitable level of digestion and refining makes the fibers desirable for use in absorbent products. The fibers of the present invention are suitable for use in roll pulp for absorbent products which are wet laid, dried and then re-fiberized from wet laid pulp sheet into fluff pulp suitable for absorbent products such as diapers and feminine hygiene pads and airlaid rollgoods. Lab scale tests using hand sheets and Waring Blender de-fiberization indicate that the annual crop fibers of the present invention can be re-fiberized from a wet laid roll pulp similar to that currently used by the diaper industry The wet laid pulp sheet typically used in the diaper industry is a Southern Pine fluff pulp fiber that has been made into a continuous web that is sheeted or rolled and dried for transport to the diaper plant where it is fed into a hammermill or similar fiberization process in the diaper making equipment. Typically, these wet laid pulp sheets have a basis weight of about 750-780 g/sq. meter, but could be made at lower or higher basis weight as required by the diaper making or other fiberization equipment.

Wheat straw fibers and soy stalk fibers were evaluated in a lab study in which the fibers were dissolved and made into rayon fibers. The molecular weight of the fibers was lower than desired for dissolving pulp. No other issues were identified.

Each application may require specific levels of digestion and refining to provide the appropriate level of fiber length, coarseness, and apparent fiber diameter for the end use.

A surprising result is that the soy stalks can be easily digested and refined with normal annual crop straw pulping and refining processes into fibers beneficial for the aforementioned uses. Soy stalk may be digested and refined at the same conditions as wheat and therefore provides value and improved ease of providing mixtures of soy and wheat fibers. Soy fibers and wheat fibers can use the same processing conditions for converting the fibers to products such as molded trays in the Thermoformed Pulp Process which provides the ability to use a broad range of mixtures from about 5% soy/95% wheat to about 95% soy/5% wheat by weight. The fibers and mixtures of the present invention are also suitable for use in Molded Pulp and Transfer Molded Pulp processes and applications. Less cooking and less refining result in longer effective fiber length and apparently larger diameter fibers in the form of multiple fiber cells that remain bonded in the manner of the original straw or stalk. Fibers having multiple fiber cells bonded together in the manner of the original straw structure to form fibers with larger apparent diameter drain faster in wet laid processes. The advantages of the Soy Stalk fibers are their ability to be easily digested and refined, smooth and strong wet laid paper and paper board, molded pulp containers and trays and food processing containers, and tissue and toweling. Fiber coarseness and length may be adjusted to accommodate the needs of the particular end use.

A most surprising result is that mixtures of soy stalk fibers with wheat straw fibers produces a unique balance of properties not attainable with any single fiber type. When soy fibers are mixed with wheat fibers in ratios of about 5% to 95% of soy stalk fiber and about 95% to 5% wheat straw fiber, the resultant mixtures have more pleasing color for various applications. The mixtures of soy stalk fibers and wheat stalk fibers allow the fiber manufacturer and the end product manufacturer to obtain twice the amount of fiber available from any one fiber source since such as wheat or soy alone. Crops must be rotated annually and the normal practice is to rotate wheat with soy for soil quality retention. Therefore there is a greater supply of the mixtures than each fiber alone. Other fiber types such as wood fiber, synthetic fiber and other annual crop fibers may be added without departing from the scope of this invention when the soy to wheat ratio of about 5% to 95% soy and about 95% to 5% wheat is maintained.

Another aspect of the present invention is the use of annual crop fiber mixtures of soy stalk fibers and wheat straw fibers in absorbent products. It has been discovered that oat, wheat, soy, and other annual crops straws may be processed into fibers suitable for absorbent products such as baby and adult diapers, feminine hygiene products, and other absorbent products. The mixtures of soy fiber and wheat fiber produce surprising improvements over any single fiber; such improvements include pleasing color as well as increased supply due to crop rotation between soy and wheat.

The annual crops fibers of the present invention represent a "green" environmentally friendly fiber to replace wood pulp currently used. The annual crop fibers have less impact on the environment due to less chemicals used to digest, no bleaching, and use of waste agricultural crops instead of harvested trees or food products such as soy beans or corn. The fibers of the present invention for absorbent products have an optimum level of digestion and refining to produce fibers which have coarseness, diameter, and length suitable for wet laying and water drainage rate and which can be re-fiberized from a wet laid pulp sheet in a hammermill or other suitable fiberizing equipment. The optimum length and coarseness are suitable for absorbent products and may be used to produce quality fluff pulp comparable to Kraft wood pulp (southern Pine) currently extensively used in diapers and other absorbent products. The present fibers can be fiberized from wet fibers that have been dried in "crumb" form from a screw press, sheets or rolls from a paperboard machine, or other suitable process.

The fiber mixtures of the present invention have excellent absorbent properties compared to Kraft wood pulp currently used in diapers and other absorbent products. They are very hydrophilic and have high free swell capacity, capacity under load, water retention values, vertical wicking, softness, and high fluid acquisition rate which is equal to or superior to Southern pine fluff pulp. Laboratory tested samples of the soy stalk fibers in absorbent core produced the following results which are comparable to Kraft wood fluff pulp:

Soy Stalk Fiber:

Free swell, g/g=13.6

Capacity under 1 psi load, g/g=7.8

Vertical wicking capacity, g/g=11.8

Wheat Straw Fiber:

Free swell, g/g=17.6

Capacity under 1 psi load, g/g=11.1

Vertical wicking capacity, g/g=10.6

The fibers of the present invention can also be made hydrophobic by lower level of digestion and less removal of waxes and lignin from the fibers. The hydrophobic fibers are more suitable for molded pulp products that require water hold out for food service and other applications.

DESCRIPTION OF THE VIEWS OF THE DRAWINGS

Table 1 shows the data collected regarding the relationship of the wheat and soy fiber blend with respect to the Canadian Freeness. The Canadian freeness drops as the ratio of soy fibers in the blend are increased and the wheat fiber content is decreased.

DETAILED DESCRIPTION OF THE PREFERRED EMBODIMENTS

Figure 1:
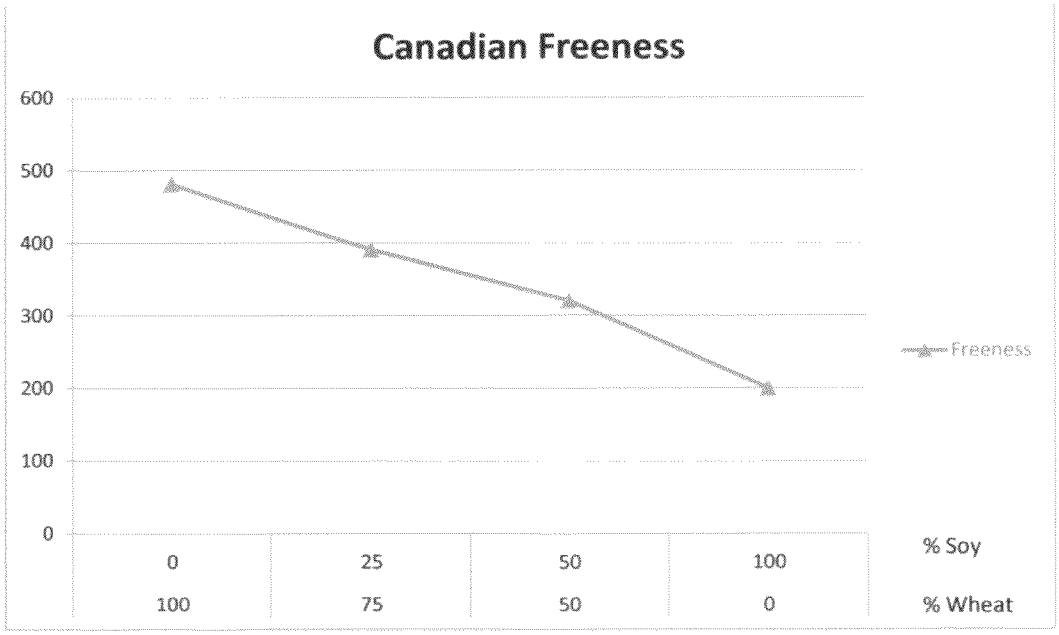
FIG. 1 is a graph giving a visual display of the data in Table 1. The graph shows the Canadian freeness dropping as the ratio of soy to wheat increases.

The fibrous product mixtures of the present invention are annual crop fibers from wheat straw and soy stalks processed to coarseness levels, diameter, and length suitable to the requirements of the end use. The soy and wheat fiber of the present invention can be digested, refined and converted to end products at the at the same process conditions which provides the unique ability to use a broad range of soy and wheat fiber mixtures of about 5% soy/95% wheat to about 95% soy/5% wheat by weight.

For absorbent products, the fibers have a high degree of wettability and water retention, a high coarseness and long fiber length achieved by medium level of digestion/cooking and low level of refining. Also, the fibers are re-fiberizable from a wet laid paper board or an oven dried particle or crumb. The term re-fiberizable is defined as the ability to be separated into individual fibers cells or fibers containing multiple fiber cells by suitable process equipment such as a hammer mill. These re-fiberized materials will have low knots or knits and will have the characteristics needed to airlay into absorbent pads with suitable capacity, wicking, fluid acquisition, pad integrity, and wettability. The re-fiberizing is performed in a typical diaper process hammermill or similar fiberizing equipment. Long textile fibers are not suitable for airlaying or mixing with SAP for diapers and other absorbent products due to lack of containment of the SAP in the very coarse and long, straight fibers that are not suitable for hammermilling into fluff pulp. These extremely long fibers would tend to tangle and jam hammermills and other fiberizing systems. For paper, paperboard, Molded Pulp, Transfer Molded Pulp, Slush Molded Pulp and Thermoformed Pulp applications and related products, the fiber mixtures have a range of coarseness, diameter, and fiber lengths to provide a unique balance of sheet smoothness and strength along with pleasing color, as well as increased supply availability. The fibers may be made to be hydrophobic for food handling applications through the addition of sizing agents and low levels of digestion. These properties are achieved by various levels of digestion/cooking and various level of refining to produce fibers having individual fiber cells and fibers containing multiple fiber cells bonded in the manner of the original straw or stalk and by the appropriate mixture of soy stalk fiber and wheat straw fiber.

Mixtures with enhanced properties contain about 5-95% soy stalk fibers and about 95-5% wheat straw fibers. Most preferable, the mixtures of about 70% wheat/30% soy to about 30% wheat/70% soy offer more enhanced benefits including but not limited to pleasing color and optimum coordination of use with available crop production and crop rotation.

Another embodiment of the present invention is paper, paperboard, tissue and toweling, and other related products comprising these fibers. Paper product may include writing paper, copy paper, magazine stock, newsprint, liner board, corrugated medium, compression molded paper dinner plates, paperboard, coated and uncoated freesheet, wet laid tissue and toweling and napkins. The annual crop fibers from wheat straw, and soy stalk may be present in these products in a ratio from about 5% to 95% soy stalk fiber and 95% to 5% wheat straw fiber by weight. Other fibers such as wood fiber, recycled paper, or synthetic fibers may be blended with the soy and wheat while maintaining the stated ratios of soy and wheat fibers without being outside the scope of this invention; however, other fiber additions may produce less optimum properties in the final product.

Another embodiment of the present invention is its use in the Thermoformed Pulp process and products including but not limited to food trays, clam shells, plates, cups, and bowls. Surprisingly, it has been discovered that the soy stalk and wheat straw fiber mixtures of the present invention provide significant benefits in the Thermoformed Pulp processes including, but not limited to, significant reduction or elimination of ragged or fuzzy molded part edges and significant reduction or elimination of steam bubbles in the molded part. It has been discovered that wheat straw fibers lose water rapidly during the heated drying of the molded part in the Thermoformed Pulp process; this causes gas bubbles to form in the final product which results in rejected parts. Mixing of soy stalk fibers with the wheat straw fibers even at about 5% level and up to about 95% level practically eliminates the gas bubble problem. It has also been discovered that the wheat fiber alone does not provide a smoothly trimmed (water spray trimming) part, but tends to have fuzzy or ragged edges which are unacceptable and have an unpleasant appearance. Surprisingly, the addition of soy fiber to the wheat even at about 5% level and up to about 95% level significantly improves the trimming and thereby provides smooth edges to the molded parts. The parts molded from mixtures of soy and wheat fibers have a more pleasing color than parts made from either fiber alone. The wheat fiber has a yellow color which is unpleasant in food applications and the soy fiber has a brown, unpleasant color as well. The mixtures of soy fiber and wheat fiber even at about 5% soy fiber and up to about 95% soy fiber by weight provide a pleasant tan color more suitable to food use applications. Also, the molded parts made from the mixtures feel smoother and have a more pleasant texture to them than parts made with either fiber alone. Another significant benefit of the soy fiber/wheat fiber mixtures is the slower water wicking rate provided by the soy fibers which is critical to food service applications for the molded products. The aforementioned benefits are apparent at mixtures containing from about 5% soy stalk fiber/95% wheat straw fiber to 95% soy stalk fiber/5% wheat straw fiber. More preferably the mixtures of this invention contain from about 10% soy stalk fiber/90% wheat straw fiber to about 90% soy stalk fiber/10% wheat straw fiber. Most preferably, the mixtures of the present invention contain from about 30% soy stalk fiber/70% wheat straw fiber to about 70% soy stalk fibers/30% wheat straw fibers. These benefits provided by the fibers and mixtures of the present invention also apply to Molded Pulp, Slush Molded Pulp, and Transfer Molded Pulp processes and products.

Molded Pulp or Molded Fiber are general terms known in the industry and refer to processes that convert a variety of fibers into a variety of shaped articles. The processes included in the Molded Pulp technology include Transfer Molded Pulp, Slush Molded Pulp, and Thermoformed Pulp. Fibers used in these processes include but are not limited to recycled paper, paper bags, paperboard, newsprint, annual crop fibers, and virgin and recycled cellulose wood fibers. Shaped articles include but are not limited to food service applications such as plates, bowls, clamshells, cups, trays and other beverage and food carriers; also, shaped articles may include urinal trays, egg cartons, and support packaging. Some articles are manufactured by compression molding paperboard sheets into plates, and bowls using matched male and female molds. Transfer Molded parts are mostly thin (1/16" to 3/16"). The Transfer Molding Process uses fine wire mesh mold which is mated with a vacuum chamber that draws water through the mesh chamber with the mesh mold suspended above a liquid return pool. The fibrous slurry is sprayed from below onto the mold and then vacuum draws the slurry tightly against the mesh filling all gaps and spaces. When air through the mesh has been sufficiently blocked, then the excess slurry falls into the return pool for recycling and the mold advances to the drying process where the article is separated from the mold and dried in an oven. Thermoformed Pulp is the newest form of Molded Pulp and is the highest quality thin walled product. The process uses the "Cure-In-The-Mold" technology which makes a well-defined smooth surface. In this process, the article is formed by vacuum on a wire mesh mold which is submerged in a slurry of fiber. The formed article is then transferred to a heated forming mold which presses, densifies and dries the molded product. When the article is dry, it is then ejected from the heated mold as a finished product. Slush molding is used for thicker parts (3/16" to 1/2") such as support packaging.

Yet another embodiment of the present invention is the absorbent core for baby diapers, feminine hygiene products, adult incontinent products, training pants, and sanitary napkins, and also wipes, airlaid rollgoods or webs for use in diapers, wipes, toweling, diaper absorbent cores, and feminine hygiene products such as sanitary napkins. The yellow color of wheat straw fibers and the dark brown color of soy stalk fibers are undesirable in absorbent products and therefore, the mixture of soy stalk fibers and wheat straw fibers are desirable due to the pleasing tan color obtained with the mixture.

The fibrous product of the present invention is the mixture of soy stalk fibers and wheat straw fibers in the ratio of about 5% to 95% soy stalk fibers and about 95% to 5% wheat straw fibers by weight. Mixtures with enhanced properties contain about 5-95% soy stalk fibers and about 95-5% wheat straw fibers by weight. Most preferable, the mixtures of 70% wheat/30% soy to 30% wheat/70% soy offer more enhanced benefits including but not limited to pleasing color and optimum coordination of use with available crop production and crop rotation.

The fibrous product may also include other fibers such as wood pulp, recycled paper and paperboard and corrugated medium and liner board and the like as well as synthetic fibers such as rayon, nylon, polypropylene, polyethylene, and polyester, and annual crop fibers such as sugar cane, oats, corn, bagasse, cotton, and jute providing that the ratio of soy fiber to wheat fiber is in the ratio of about 5% to 95% soy fiber and about 95% to 5% wheat fiber.

The following examples further illustrate the present invention and its benefits as well as its unique features.

EXAMPLE #1

Harvested wheat straw was obtained in bale form and processed through a Hay Grinder with a 3 inch minus screen to provide chopped fiber. Fifty kilograms of chopped straw was placed in a digester at 10% consistency and 10% NaOH caustic by dry fiber weight. The mixture was then cooked at 190 degrees Fahrenheit for one hour. The digested fiber slurry was then refined using a 12" Sprout Waldron double disc refiner set at minimum plate clearance. The refined fiber was then dewatered to about 25% solids using a screw press. The dewatered fiber was then diluted with water to 4% consistency. The product was then pumped through a pressure screen using a 0.20" slotted screen; the accepts that passed though the screen were saved for use in making product and testing fiber and product properties reported in this application.

EXAMPLE #2

Harvested soy stalk was obtained in bale form and processed through a Hay Grinder with a 3 inch minus screen to provide chopped stalk. Fifty kilograms of chopped stalk was placed in a digester at 10% consistency and 10% NaOH caustic by dry fiber weight. The mixture was then cooked at 190 degrees Fahrenheit for one hour. The digested fiber slurry was then refined using a 12" Sprout Waldron double disc refiner set at minimum plate clearance. The refined fiber was then dewatered to about 25% solids using a screw press. The dewatered fiber was then diluted with water to 4% consistency. The product was then pumped through a pressure screen using a 0.20" slotted screen; the accepts that passed though the screen were saved for use in making product and testing fiber and product properties reported in this application

EXAMPLE #3

Laboratory hand sheets were prepared from the finished fibers of Examples #1 and #2 as follows: the wet slurries of wheat straw fiber, soy stalk fiber and mixtures of both fibers were weighed in a beaker and transferred to a disintegrator and processed for 500 revolutions. The slurry was then transferred to a hand sheet mold and wet laid into an 8"×8" sheet at 140 grams per square meter basis weight. The sheets were then dried at 300 degrees Fahrenheit, and then pressed for one minute between polished steel plates. The following hand sheet compositions were prepared:

1. 100% wheat straw fiber
2. 100% soy stalk fiber
3. 95%wheat fiber/5% soy fiber
4. 75% wheat fiber/25% soy fiber
5. 50% wheat fiber/50% soy fiber
6. 25% wheat fiber/75% soy fiber
7. 35% wheat fiber/65% soy fiber.

The fiber slurries of Example #3 containing 100% wheat straw fiber, 100% soy stalk fiber, 75% wheat straw fiber/25% soy stalk fiber, and 50% wheat straw fiber/50% soy stalk fiber were tested for Canadian Freeness and the results are reported in FIG. 1 and Table 1.

Figure 2:
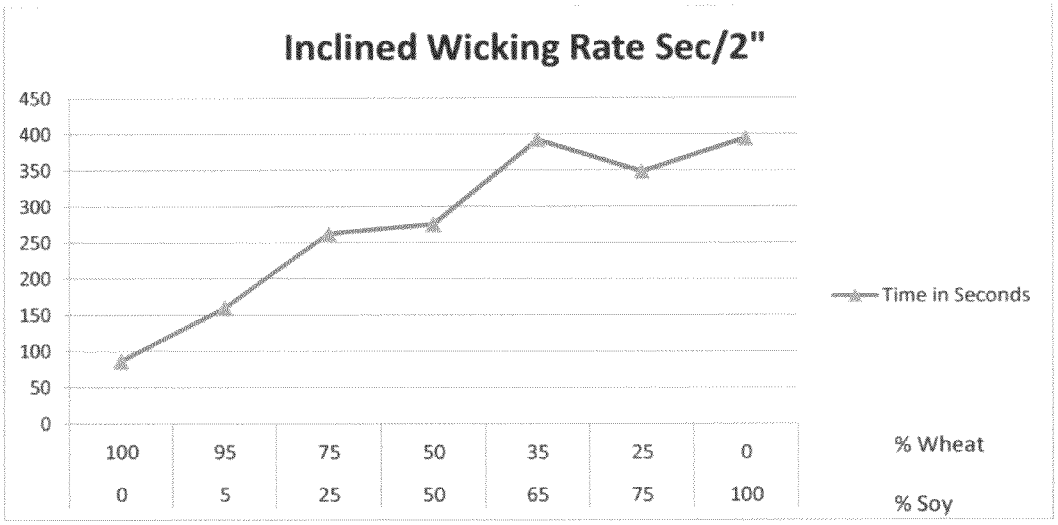
FIG. 2 is a graph of the data collected showing the effect of the ratio of wheat fibers to soy fibers in the blend on the inclined wicking rate. As the soy fibers in the ratio are increased the inclined wicking rate decreases.
Figure 3:
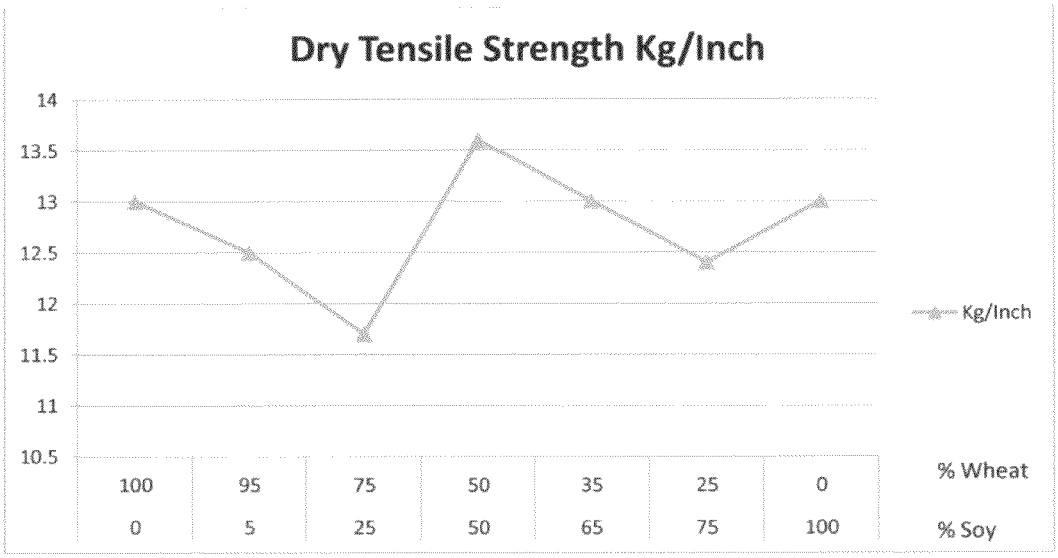
FIG. 3 is a graph of the data collected showing the effect of the ratio of wheat fibers and soy fibers on dry tensile strength. The data shows the dry tensile strength is statistically unaffected by the change in the ratio of the blend. The dry tensile strength is maintained regardless of the ratio of wheat fibers to soy fibers.
Figure 4:
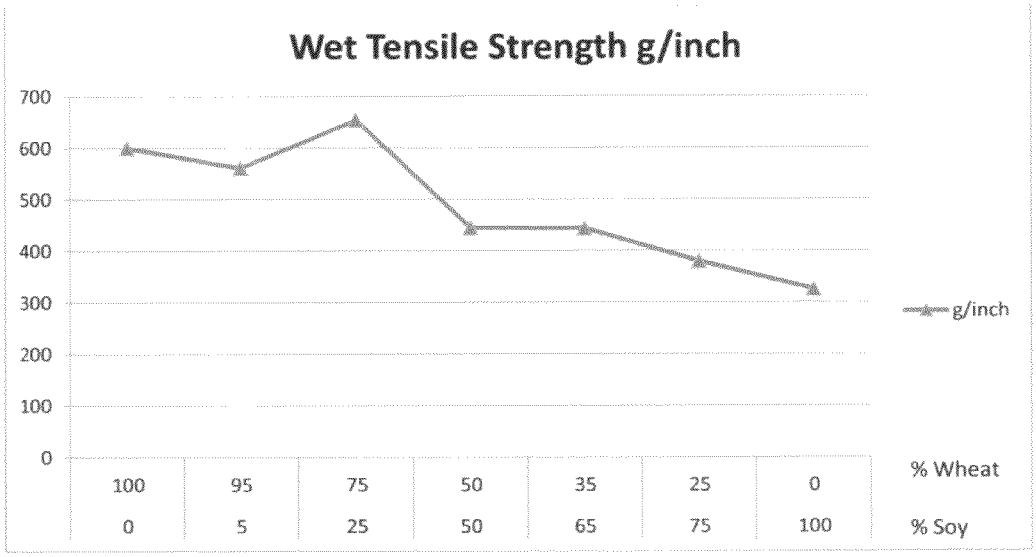
FIG. 4 is a graph of the data collected showing the effect of the ratio of wheat fibers to soy fibers in the blend on wet tensile strength. The wet tensile strength decreases as the ratio of soy fibers is increased in the blend.

The hand sheets from example #3 were then tested as follows:

1. Inclined wicking rate and capacity: 1"×4" specimens were cut from the handsheets. The specimens were placed on a metal screen positioned at a 30 degree angle with the horizontal. Water was introduced to the bottom ¼" of the specimen. The time for the water to wick to a height of 2" on the specimen was recorded as the inclined wicking rate in seconds. These results are shown in FIG. 2.
2. Dry tensile strength: specimens were cut from the hand sheets to ¼" wide by 4" long. The specimens were then clamped into holding fixtures with a 2" span between the fixtures. One fixture was attached to a digital scale. The other fixture was manually pulled until the specimen failed and the load at failure was recorded as grams per inch of specimen width. The results are shown in FIG. 3.
3. Wet tensile strength: specimens were cut from the hand sheets to ½" wide by 4" long. The specimens were then clamped into holding fixtures with a 2" span between the fixtures. One fixture was attached to a digital scale. Three drops of water were applied with an eye dropper to wet the specimen at the center of the span. The other fixture was manually pulled until the specimen failed and the load at failure was recorded as grams per inch of specimen width. The results are shown in FIG. 4.
4. Color: the 8" by 8" hand sheets were visually evaluated for,color. Color differences and color appeal were noted and subjectively evaluated.

The Canadian Freeness results are shown in Table 1 and FIG. 1. These results show that the wheat straw fiber alone has a good freeness value of 480 and the soy stalk fiber alone has a low freeness value of 200 which may represent a limiting manufacturing rate in some wet laid applications. As the soy stalk fiber content increases, the freeness of the mixture is lowered. Above 50% by weight of soy stalk fiber there may be manufacturing limitations in high basis weight wet laid sheets. There may be no issue with low basis weight products such as tissue and toweling or wipes for instance. Experience with the Thermoformed Pulp Process indicates no effect of the low Canadian Freeness on the cycle time or product quality and it was found that the soy stalk fiber improves the water spray trimming function so that the products have clean edges. It was discovered that wheat straw fiber alone does not trim cleanly and the product edges are fuzzy and ragged.

The inclined wicking rate results are show in FIG. 2. The wicking rate of the 100% wheat straw fiber is the highest and the rate decreases rapidly as soy stalk fiber is added. Although the decreased wicking may be an issue in absorbent products; it is a significant advantage in Thermoformed Pulp products for food service since these products require excellent water hold out. The decreased water wicking creates an opportunity for decreased use of water hold-out additives and decreased cost. The decreased wicking may also be advantageous in printing paper for ink hold-out, milk and juice carton, and coffee cups and other liquid holding containers produced from paperboard.

The dry tensile strength results are shown in FIG. 3. These results indicate little or no difference in dry tensile strength between 100% wheat straw fiber, 100% soy stalk fiber and all combinations of wheat and straw fiber mixtures. This result confirms the ability to gain the benefits (crop supply coordination and color enhancement) of the soy stalk fiber and wheat straw fiber mixtures without sacrificing strength required in paperboard, related products fabricated from paperboard, and Thermoformed Pulp Products.

The wet tensile strength results are shown in FIG. 4. The 100% soy stalk fiber has about 33% lower wet strength than 100% wheat straw fiber. However, the results indicate that at least 30% soy stalk fibers may be added without affecting the wet strength; above 40% soy stalk fiber by weight the wet strength decreases gradually as the level approaches 100% soy stalk fiber. The low wicking rate of the soy stalk fibers may help to alleviate any decrease in wet strength of the products since they are likely to absorb less water or at least absorb slower.

The color of the hand sheets of Example #3 were subjectively evaluated for color and shade appeal and pleasantness. The 100% wheat straw fiber sheets were yellow and were not appealing for use in absorbent products or food service items. The 100% soy stalk fiber sheets were dark brown and also did not have high appeal for absorbent products or food service items. However, the sheets containing mixtures of wheat straw fiber and soy stalk fiber were tan in color and had more appeal for absorbent products and food service items.

TABLE 1

| Canadian Freeness | | |
|---|---|---|
| Fiber | | |
| % Wheat | % Soy | Freeness |
| 100 | 0 | 480 |
| 75 | 25 | 390 |
| 50 | 50 | 320 |
| 0 | 100 | 200 |

The invention claimed is:

1. A fibrous product comprising a mixture of soy stalk fibers and wheat straw fibers in a ratio of about 30% to about 70% soy stalk fibers and about 70% to about 30% wheat straw fibers by weight.

2. The fibrous product of claim 1, further comprising synthetic fibers.

3. The fibrous product of claim 1 further comprising natural fibers.

4. The fibrous product of claim 1 further comprising annual crop fibers.

5. A molded pulp article comprising a mixture of soy stalk fibers and wheat straw fibers in a ratio of about 5% to about 95% soy stalk fibers and about 95% to about 5% wheat straw fibers by weight.

6. The molded pulp article of claim 5, further comprising a mixture of soy stalk fibers and wheat straw fibers in a ratio of about 10% to about 90% soy stalk fibers and about 90% to 10% wheat straw fibers by weight.

7. The molded pulp article of claim 5, further comprising a mixture of soy stalk fibers and wheat straw fibers in a ratio of about 30% to about 70% soy stalk fibers and about 70% to about 30% wheat straw fibers by weight.

8. The molded pulp article of claim 5, further comprising synthetic fibers.

9. The molded pulp article of claim 6, further comprising synthetic fibers.

10. The molded pulp article of claim 7, further comprising synthetic fibers.

11. The molded pulp article of claim 5 further comprising natural fibers.

12. The molded pulp article of claim 5 further comprising annual crop fibers.

13. The molded pulp article of claim 6 further comprising natural fibers.

14. The molded pulp article of claim 6 further comprising annual crop fibers.

15. The molded pulp article of claim 7 further comprising natural fibers.

16. The molded pulp article of claim 7 further comprising annual crop fibers.

17. A thermoformed pulp article comprising a mixture of soy stalk fibers and wheat straw fibers in a ratio of about 5% to about 95% soy stalk fibers and about 95% to 5% wheat straw fibers by weight.

18. The thermoformed pulp article of claim 17, further comprising a mixture of soy stalk fibers and wheat straw fibers in a ratio of about 10% to about 90% soy stalk fibers and about 90% to 10% wheat straw fibers by weight.

19. The thermoformed pulp article of claim 17, further comprising a mixture of soy stalk fibers and wheat straw fibers in a ratio of about 30% to 70% soy stalk fibers and about 70% to 30% wheat straw fibers by weight.

20. The thermoformed article of claim 17 further comprising synthetic fibers.

21. The thermoformed pulp article of claim 18 further comprising synthetic fibers.

22. The thermoformed pulp article of claim 19 further comprising synthetic fibers.

23. The thermoformed pulp article of claim 17 further comprising natural fibers.

24. The thermoformed pulp article of claim 17 further comprising annual crop fibers.

25. The thermoformed pulp article of claim 18 further comprising natural fibers.

26. The thermoformed pulp article of claim 18 further comprising annual crop fibers.

27. The thermoformed pulp article of claim 19 further comprising natural fibers.

28. The thermoformed pulp article of claim 19 further comprising annual crop fibers.

* * * * *